US005100154A

United States Patent [19]

Mullins

[11] Patent Number: 5,100,154

[45] Date of Patent: Mar. 31, 1992

[54] TIMED GROUP-WRITING GAME WITH RANDOM CHARACTERIZATIONS

[76] Inventor: Edwin I. Mullins, P.O. Box 280436, Dallas, Tex. 75228

[21] Appl. No.: 545,524

[22] Filed: Jun. 29, 1990

[51] Int. Cl.[5] ..... A63F 9/00

[52] U.S. Cl. ..... 273/429; 273/459; 434/156

[58] Field of Search ..... 273/459, 272, 429; 434/236, 156

[56] References Cited

U.S. PATENT DOCUMENTS

| | | | |
|---|---|---|---|
| 3,116,927 | 1/1964 | Kuhlman | 273/272 |
| 3,831,938 | 8/1974 | Neubauer | 273/1 R |
| 3,891,209 | 6/1975 | Kritzberg | 273/1 R |
| 4,123,051 | 10/1978 | Tasecoyannis | 273/429 |
| 4,132,406 | 1/1979 | Ginsberg | 273/272 X |
| 4,445,869 | 5/1984 | Wasserman | 434/156 |
| 4,470,821 | 9/1984 | Lecapelain | 273/272 X |
| 4,741,538 | 5/1988 | Lewis | 273/272 X |

*Primary Examiner*—William H. Grieb

[57] ABSTRACT

A time limited game for a group of player-participants to share in the composition of several short stories, and including the means to achieve such composition. A timer is provided for limiting writing time. Five sets of cards are provided to determine a character profile for each player's main character. A spinner is provided to determine the genre category in which each player is required to compose. Participants compose the beginnings of a short story in the genre chosen, about a character described by the character cards and write as much as possible within a set time limit. At the end of the time limit, story compositions are passed to the player at each player's left, and writing continues for another set time limit. The same process is repeated until all participants have contributed to every other participant's story once. Story endings and story titles are added. Stories are read and awards are given for different categories of composition. The player with the most awards is declared the winner.

1 Claim, 9 Drawing Sheets

TIMED GROUP-WRITING GAME WITH RANDOM CHARACTERIZATIONS

BACKGROUND OF THE INVENTION

1. Field of the Invention

This invention relates in general to games, and in particular to games involving word groupings, sentences, and group composition of short stories.

2 Prior Art

For as long as the field of writing has existed, professional and amateur writers have had a need to find new ways to stimulate their own creativity. The problem has always been to do so in a way which would be exciting to the participant as well as inject a healthy amount of competitiveness during any such exercise.

One of the most innovative ways to stimulate that creativity, to promote ideas, and encourage practice of the art of writing is through the use of a game. This invention, through the use of participatory group writing and random character selection, provides all the prerequisites for producing such creativity enhancement.

Other games have attempted to promote the use and the building of language. These attempts, such as disclosed in LeCapelain U.S. Pat. No. 4,470,821, rely mostly on the very rudiments of word structure. The emphasis in the aforementioned patent is on grammatically correct sentence structure only. Much of the prior art builds upon the individual components of the alphabet to form words. The Lewis U.S. Pat. No. 4,741,538 is a typical example of creating individual words by adding letters to other letters. This is a common theme of many related game patents.

There are also other patents of reference such as the Kritzberg U.S. Pat. No. 3,891,209, which involves a random selection of stimulii in the form of individual words to promote storytelling as an aid for psychological testing. However, there is no provision in the Kritzberg patent for group writing or composition. Nor does the Kritzberg patent allow for random creation of individual characters to be used in the writing process.

Other patents of interest would be U.S. Pat. Nos.

3,116,927—Kuhlman issued—January 1964

4,132,406—Ginsberg issued—January 1979

Again, these patents involve the adding together of letters to form words, or the adding of words to form short sentences for the purposes of promoting word formations and proper sentence structures. All of the previously mentioned patents are useful, but none are useful in promoting the art of short story compostiion.

I am totally unaware of any other games which aid and promote short-story writing, or group composition of any kind.

SUMMARY OF THE INVENTION

The principal object of this invention is to help increase the creativity of aspiring writers and game participants. Given the varying choices of characterization provided by cards, and choice of genre, provided by a spinner-selector, the game provides and ideal setting for freeing a writer's imagination.

Another object is to increase the productivity of writers. Writing under a time limit forces a writer to circumvent not knowing who, or what to write about. This lack of knowledge is sometimes referred to as "writer's block".

Mere participation is also a purpose for the invention. As with any game, the pure enjoyment of bettering one's peers within the confines of a friendly game is also an important objective. Non-aspiring writers as mere participants will enjoy seeing, or reading what they can do in the field of writing. It is even possible a participant could discover a latent talent for short story writing.

All of the foregoing objects can be accomplished within the confines of the game as summarized:

The game is controlled by a spinner which indicates the genre of writing in which each participant will write, a timer to limit the amount of writing time, and cards to suggest characterizations for the subject matter. Each writing participant, or player, is instructed to write in the given genre about the type of character provided, and do so for a set time limit. At the end of the time limit, each writer's story is passed to the left and the writing continues for an additional set time period. This process is continued until all participants have added composition to all the other participants' stories once. Stories are then read and reviewed. The game winner is the player with the most awards.

DETAILED DESCRIPTION

Figure 1:
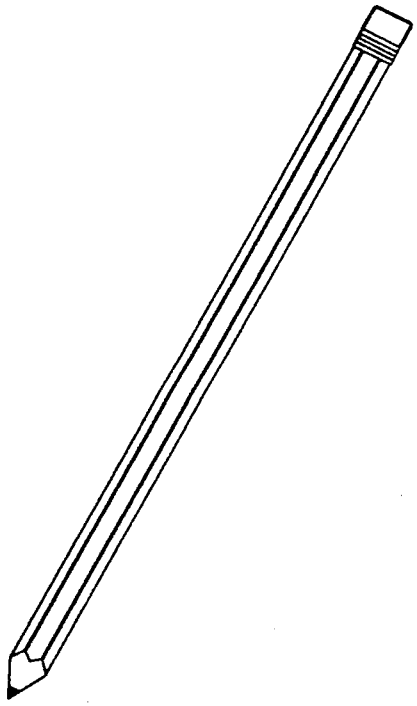
FIG. 1 shows standard writing utensils (pens, pencils, etc.)
Figure 2:
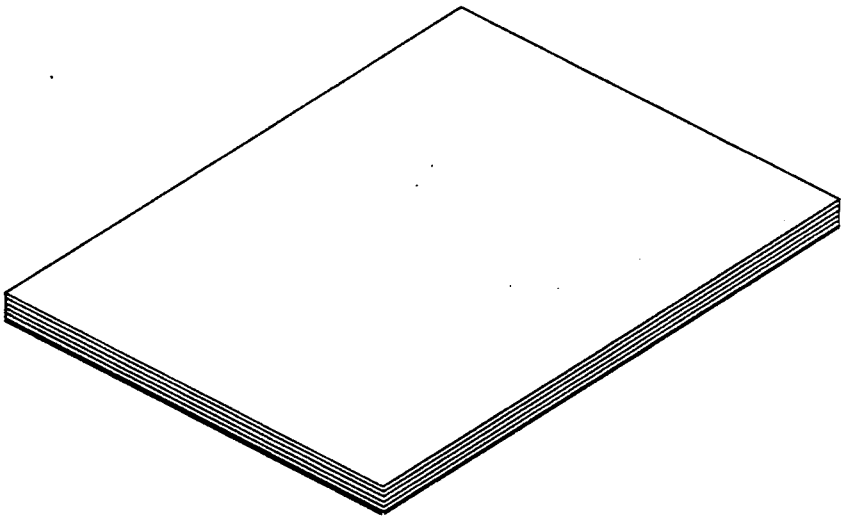
FIG. 2 is standard writing materials (all forms of paper).
Figure 1A:
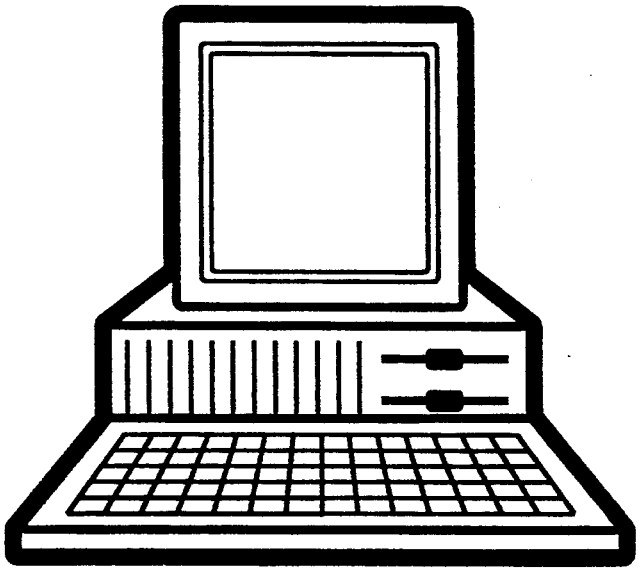
FIG. 1A shows an alternate writing utensil in the form of a computer with display.
Figure 2A:
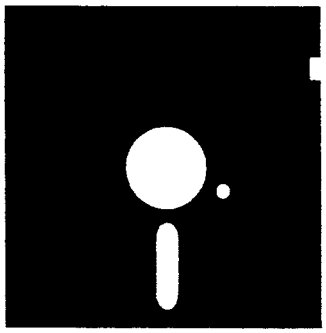
FIG. 2A shows alternate writing materials for recording and storing writing in computer memory, (example shown: computer disk).
Figure 3:
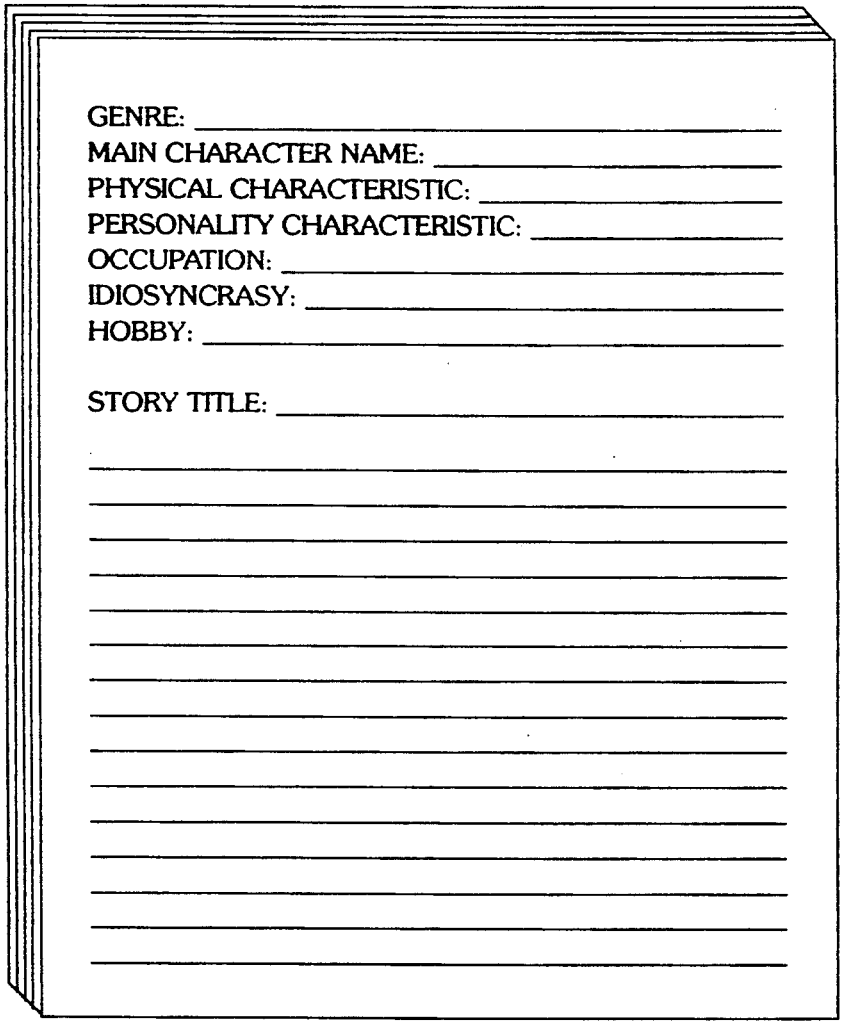
FIG. 3 shows a list of all words, with their corresponding blanks that follow, which are recorded or printed at the beginning and top portion of all writing materials.

As shown in FIGS. 1 & 2, all game participants are required to use writing utensils and materials. These may vary in size or type, FIGS. 1A & 2A, but must allow for the communication, recording, and storing of words, sentences, and paragraphs. Heading the writing materials, whether paper, computer memory, or other related means, is the following list, as shown in FIG. 3.

Figure 4:
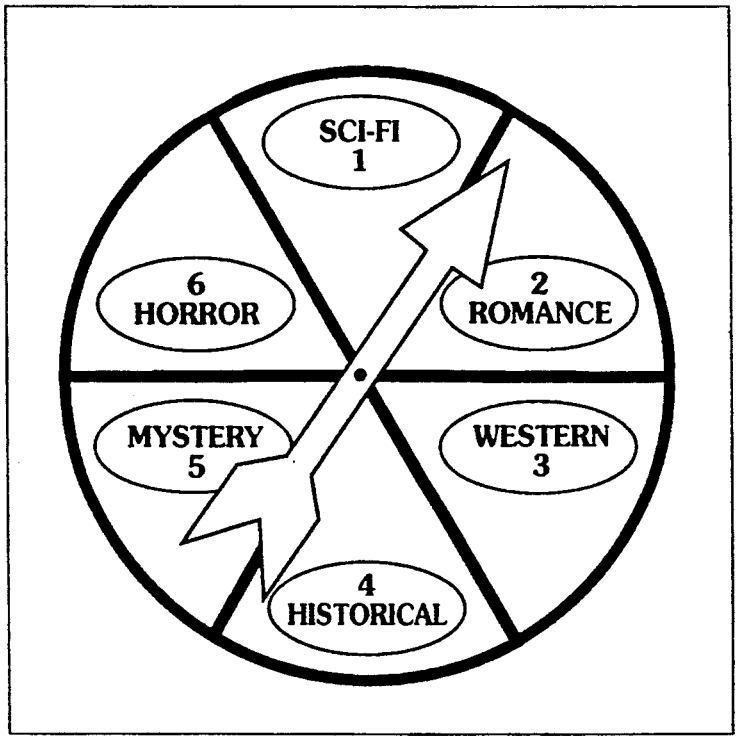
FIG. 4 shows the top view of the spinner.

GENRE:
MAIN CHARACTER'S NAME:
PHYSICAL CHARACTERISTIC:
PERSONALITY CHARACTERISTIC:
OCCUPATION:
IDIOSYNCRASY:
HOBBY:
STORY TITLE:

All of the above listed items are followed by a blank space to be filled in during the course of the game. The spinner 4 has a circle which is divided into six equally-sized pie-shaped wedges with a spinable pointer at the circle's center. Each of the wedges are numbered in order around the circle with either a 1, a 2, a 3, a 4, a 5, or a 6, with each wedge having a single different number. Each wedged section has a different genre category listed within the wedge boundary. Genre categories indicate a different style, type or kind of writing. Typical examples of genre types are shown in FIG. 4, and those are listed as follows: Sci. Fi., or Science Fiction, Romance, Western, Historical, Mystery, and Horror.

Play begins with each player first possessing proper writing utensils and materials, FIGS. 1 & 2. One player then spins the pointer on the spinner. This is to determine which player will play first. All other players must also spin the spinner. The player with the highest number indicated by the spinner will play first. If two or more players have the highest number indicated, those players must spin again until only one of those players has the highest number indicated.

The first player begins play by spinning the spinner 4 again, this time noting the genre category indicated on the spinner. The player records the genre type in the blank space to the right of the word "GENRE" as listed on 3. Play continues clockwise to player number two, who proceeds to spin the spinner 4 and record a new category of genre onto his or her own writing materials, placing it to the right of the word "GENRE". This procedure continues until all players have chosen and recorded a different genre category on their own writing materials, FIG. 2. However, if a player spins the spinner 4, and the pointer lands on a category already chosen by somebne else, the player must spin again. Genre categories indicated on the spinner may not be used by more than one player in a single game except under the following circumstances: (1). If there are more than six players. If this is the case, the seventh player, the eighth player, (and so on), may spin and take whichever category is indicated by the spinner 4, even if it has already been selected by another player, or may select a different category not shown on the spinner. If a player elects to use a genre category not shown on the spinner, the player's choice must have unanimous approval from the rest of the players. Otherwise the selection is void (2). When there are six players or less, and a player has spun the spinner 4 four times without the pointer landing on a category not already chosen the player may choose from whatever categories are left, or egory must be approved by all of the other players.

Figure 5:
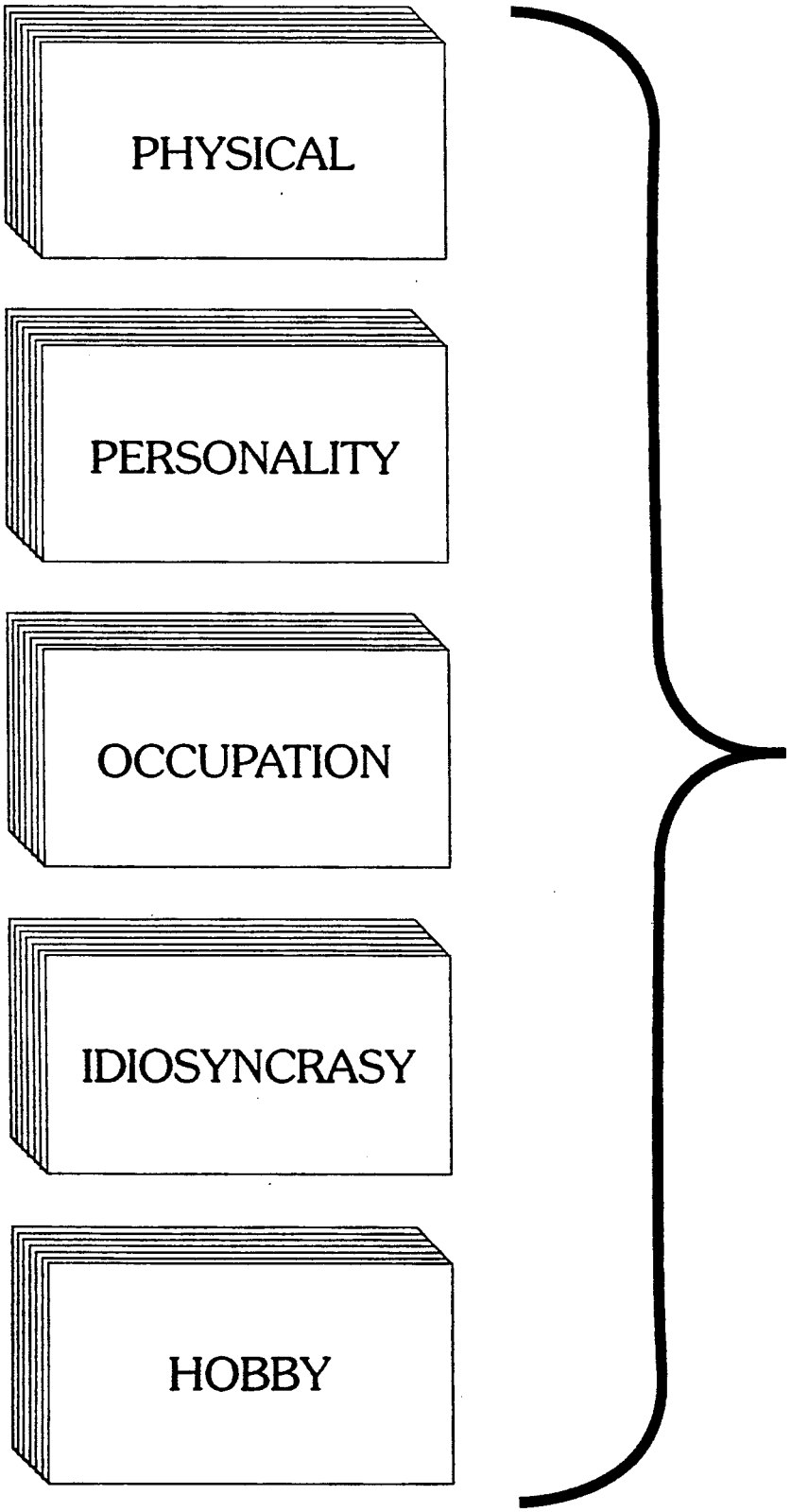
FIG. 5 shows the five sets of character cards.

Play continues once again with player number one drawing one card only from each of the five sets of "Character Cards"—FIG. 5. Character cards are used to provide a descriptive character profile of the main character the player is instructed to write about. There are five sets of these cards. Each set is different. There is one set of PHYSICAL cards, one set of PERSONALITY cards, one set of OCCUPATION cards, one set of IDIOSYNCRASY cards, and one set of HOBBY cards. PHYSICAL cards provide the player with a physical trait attributable to the player's main character. These are indicated on the bottom side of each card and are usually one to two words in length and relating to a single physical human trait such as: blonde, tall, muscular, aging, hairy, underweight, etc. Each card has only one trait. PERSONALITY cards give the player the kind of personality traits the player's main character will possess. These traits are indicated on the bottom side of each card and are usually one to two words in length and relating to a single human personality trait such as: kind-hearted, arrogant, conniving, vengeful, schizophrenic, passionate, etc. Each card lists only one trait. OCCUPATION cards indicate to a player, the main character's line of work. These are indicated on the bottom side of each card and are usually one to three words in length and relate to a type of employment such as: used car salesman, accountant, drug smuggler, detective, housewife, racecar driver, etc. Each card lists only one job title. IDIOSYNCRASY cards are for a main character's unusual, or quirky behavior patterns, or mannerisms unique to the character. These are indicated on the bottom side of each card and are usually one to ten words in length and relate to a single human idiosyncrasy or odd behavior such as: refuses to leave the house after dark, stares often at strangers, hoards food, excessive daydreamer, secretive, reads in the bathroom, etc. Each card lists only one idiosyncrasy. HOBBY cards indicate to a player the main character's use of leisure time. These are indicated on the bottom side of each card and are usually one to two words in length and relate to a single human pastime endeavor such as: restoring antiques, sewing, chess, stamp collecting, surfing, sculpting, etc. Each card lists only one hobby.

Once player number one has drawn one PHYSICAL card, one PERSONALITY card, one OCCUPATION card, one IDIOSYNCRASY card, and one HOBBY card, the player reads the information on the card silently and records the information onto the player's writing materials 2 in the corresponding blank spaces shown on 3. Players are not allowed to show any cards drawn to any other players. After recording the information shown on the cards, player number one returns the drawn cards to the bottom of each of their respective decks. The second, third, fourth players (and so on), continue play by following the same procedure as the first player. Each player will have drawn one card from each of the five decks (sets) of cards 5 and each player will have recorded the information on the cards 5 onto each player's own writing materials.

Each player is then given an unspecified, but reasonable amount of time to create a NAME for their main character. This name is then placed in the appropriate blank space provided on the writing materials, FIG. 2, directly beside the line MAIN CHARACTER NAME, as indicated in FIG. 3.

At this point, each player should now possess a complete main character profile and corresponding character name, all of which are to be indicated on each player's writing materials. Actual short story writing is now set to begin.

One player, or a neutral, non-participant, is selected to operate the timer 6. When all players are set to begin, the timer is activated. Each player then has six minutes to compose onto each player's own writing materials, the beginnings of a short story involving the main character (as described and named on 3), and do so in the genre category previously indicated by the spinner 4. given, (which was obtained from the person to the player's right), silently to themselves. Once everyone has read their newly acquired stories, and everyone is ready to write again, it is each player's objective to continue writing the story shown on their neighboring player's writing materials. Creative license is allowed, and all players are allowed to deviate from the original style, premise, or other aspects of the story, if they so desire. The only requirement is that the player continue with the story in some fashion. However, a player may not change, erase, or alter in any way, what has previously been written on a neighboring player's writing materials, whether written by the neighboring player, or by any other player. A player may only continue with what is already written by adding new sentences and new paragraphs to the story.

Before beginning any writing session, including the first writing session as previously described, players must identify their own piece of writing by using their own name enclosed in brackets [] at the beginning of their own first paragraph, and follow this procedure on each paper 2 or other writing materials 2A, onto which they write throughout the course of the game.

Again, when the timer-operator announces the end of six minutes, all players again stop writing and again pass the story in their possession to the player seated to the person's left. This same procedure of writing something on a neighboring player's paper for six minutes, passing the store to the left, reading, and then writing again, is repeated until all players have seen and written, (and contributed a section of composition), on every story once. A player, thus, may not contribute to a story twice or more times in the same game. This means, the story ending must be written by the player to a playr's right. Players will therefore know when it is time to begin the final writing session, (time to write the endings to the stories), when the next pass would have, without this rule, normally given a player back the original story the player started when the game began.

Rules for endings only: Players are alloted the same time—6 minutes—to end a story. However, if time is called in mid-sentence, players are allowed to finish their last sentence, or even a paragraph, as long as doing so does not exceed an additional flip of the timer (3 minutes). Players may not, however start new paragraphs.

Once the headings are composed and recorded, and the last time frame has ended, STORY TITLES are added to the story by the same person who ended the story. This item is recorded in the blank space shown in FIG. 3, beside the words STORY TITLE.

Once the story titles are created and recorded, a final pass of the stories to the left is executed and the players who began their stories may now have them back again.

At this point, each player may want to read their newly revised stories aloud, or the group may wish to designate a person, or persons among them to read them all aloud. Or, players may simply pass them back and forth and read them all silently to themselves. The only requirement is that all of the stories must eventually be read by all of the players prior to the final phase of the game—the award ceremonies.

Award Ceremonies: The player who began the game is automatically designated the Chairman. The Chairman begins the award ceremonies by accepting the nominations of individual players, from other players, for each of the categories below: (However, players may not nominate themselves for any category).

1. BEST OVERALL WRITING (by one person, all stories combined).
2. BEST TITLE
3. BEST TRANSITION
4. BEST ENDING
5. BEST HUMOR It should be noted that it is not necessary, or always possible for all of the above mentioned awards to be granted since some may not apply in any particular game. It is the option of the players, based on a majority vote, to add other categories not shown above, or delete those shown, in any number or amount agreed upon by the players.

Only two nominations may be accepted for each award category. Voting is done by a show of hands, with each player receiving one vote. In the event of a tie, the Chairman is required to break the tie with an additional vote. If the tie involves a piece of writing composed by the Chairman, the Chairman must decline to break the tie and must designate someone else, not nominated, to break the tie.

Figure 7:
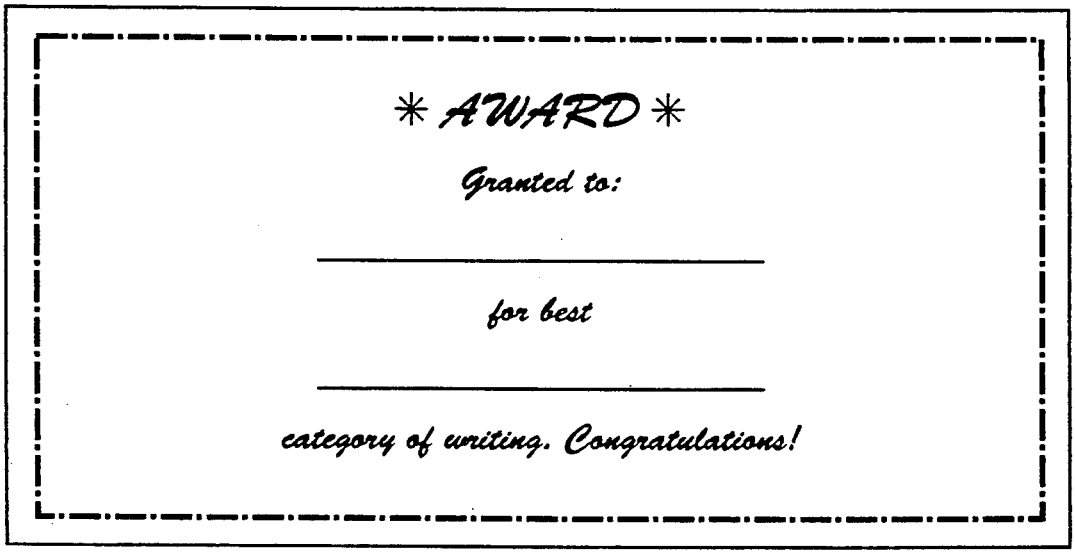
FIG. 7 shows the front view of the award certificates.

A certificate, FIG. 7, or its equivalent, is given to each person selected as the winner of each award category. However, any object my be used as a "trophy", in lieu of the certificates. The only requirement is that the object be approved by a majority of the players.

At the end of the award ceremonies, the player with the most number of awards is declared the game winner. More than one winner is allowed if two or more players have reached a tie in the number of awards won.

In addition to "BEST" awards, "WORST" awards are also given, such as WORST TITLE, WORST ENDING, WORST OVERALL WRITING, etc. These awards, their name and number, are left to the descretion of a majority of the players. It must be noted that "WORST" awards do not count towards winning of the game, and are considered valueless. Also, "WORST" awards do not negate or offset any other awards given to any player previously. "WORST" awards are only given after a winner has been declared based on all other categories of awards.

Figure 6:
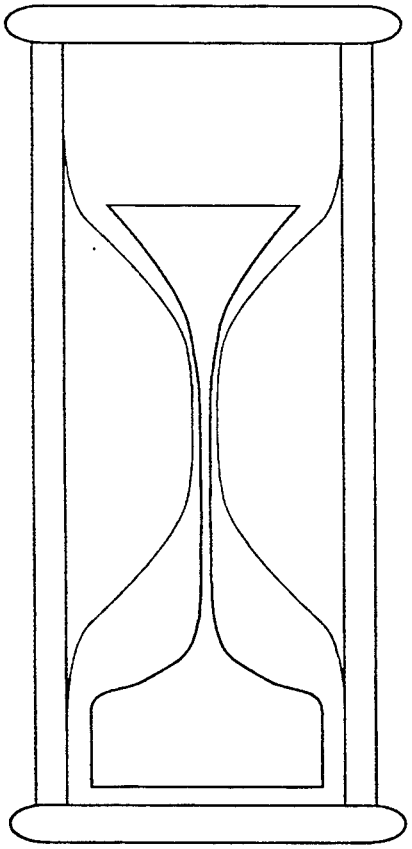
FIG. 6 is a side view of a 3-minute timer.

It must be noted that this specification is the preferred embodiment and in no way limits the use of the game in a broader sense, nor does it restrict its use to one form. As such, the entire game may be computerized, allowing, therefore, not only the physical writing and recording of the stories themselves, as suggested by FIGS. 1A and 2A, but other aspects of the game, as well. The spinner shown in FIG. 4, may be simulated by computer memory and display, allowing genre types to be determined by random computerized selection. The timer, FIG. 5, may also be computerized as can the five sets of character cards, FIG. 6. Information on the cards 6 can be stored in computer memory and later selected randomly by computer for game use. Computerization is only one variation. The scope of the invention, therefore, is not limited by the detailed description, but rather by the claims as hereto appended.

I claim

1. A game for writing and composing a plurality of stories to be created by a plurality of participants, (or players), comprising a. a means of recording or storing said stories either on paper, in computer memory, or other related means;

b. a means of determining story genre type through the use of a spinner with a circle subdivided into equally-sized genre categories and having a spinable pointer at the circle's center, or any such computer-simulated spinner;

c. a means of determining individual story charaterizations for each player's main character, through the use of five differing sets of "character cards", in plurality, and so named as to determine a story character's physical traits, personality traits, occupation(s), hobbies, and idiosyncrasies; and wherein each player is given one of each of these cards prior to composing the beginning paragraph of a new story; and/or any such simulated cards as created and stored in computer memory;

d. a means for allowing participants to add words and paragraphs to other participants' stories through the passing of stories from one player to another;

e. a mans for setting a time limit for composition of said stories;

f. a means of determining a winner, based on categories of best composition, with and through the use of, and granting of, certificates, or awards, or trophies, as well as, the means of determining poor composition through the use of and granting of similar awards, certificates, or trophies for such, as so determined by a majority of participants.

* * * * *